US007536874B2

(12) United States Patent
Ray et al.

(10) Patent No.: US 7,536,874 B2
(45) Date of Patent: May 26, 2009

(54) JEWELRY ITEM WITH ROTATING GEMSTONE

(76) Inventors: Claude Ray, 2205 Montezillon, Montezillon (CH); Joseph C. Koll, 3901 Wanda Lynn St., Metairie, LA (US) 70002

( * ) Notice: Subject to any disclaimer, the term of this patent is extended or adjusted under 35 U.S.C. 154(b) by 443 days.

(21) Appl. No.: 10/824,827

(22) Filed: Apr. 15, 2004

(65) Prior Publication Data

US 2008/0016913 A1 Jan. 24, 2008

(51) Int. Cl.
*A44C 17/02* (2006.01)

(52) U.S. Cl. ..... 63/31; 63/30; 63/29.1

(58) Field of Classification Search ..... 63/26–29.2, 63/30, 31; 40/414; 451/389
See application file for complete search history.

(56) References Cited

U.S. PATENT DOCUMENTS

| | | | | | |
|---|---|---|---|---|---|
| 340,108 | A | * | 4/1886 | Gaensslen | 63/31 |
| 635,826 | A | * | 10/1899 | Wandry | 63/31 |
| 831,033 | A | | 9/1906 | Boismaure | |
| 1,025,447 | A | * | 5/1912 | Blume | 63/31 |
| 2,190,778 | A | | 2/1940 | Fernandez | |
| 3,247,683 | A | | 4/1966 | Dankner | |
| 3,997,686 | A | | 12/1976 | McClure | |
| 4,052,864 | A | * | 10/1977 | Hofsaess | 63/31 |
| 4,187,697 | A | | 2/1980 | Castelo | |
| 4,245,486 | A | * | 1/1981 | Matsumoto et al. | 63/23 |
| 4,270,366 | A | * | 6/1981 | Green | 63/3 |
| 4,764,850 | A | * | 8/1988 | Albanese | 362/35 |
| 4,970,810 | A | * | 11/1990 | Liou | 40/414 |
| 4,977,757 | A | | 12/1990 | Mesica et al. | |
| 5,372,049 | A | * | 12/1994 | Chuang | 74/30 |
| 5,393,578 | A | * | 2/1995 | Yang | 428/7 |
| 5,896,687 | A | * | 4/1999 | Lo | 40/411 |
| 5,971,829 | A | * | 10/1999 | Hartman | 446/236 |
| 6,209,242 | B1 | * | 4/2001 | Marshall | 40/414 |
| 6,408,647 | B1 | * | 6/2002 | Koll | 63/31 |
| 6,502,338 | B1 | * | 1/2003 | Marshall | 40/430 |
| 6,592,423 | B1 | * | 7/2003 | Boyle et al. | 446/175 |
| 6,764,375 | B1 | * | 7/2004 | Hsu | 446/236 |
| 6,857,289 | B1 | * | 2/2005 | Cheng | 63/31 |
| 2002/0148253 | A1 | * | 10/2002 | Fernandes | 63/31 |
| 2004/0144005 | A1 | * | 7/2004 | Young | 40/414 |

FOREIGN PATENT DOCUMENTS

| | | |
|---|---|---|
| CH | 666996 | 9/1988 |
| DE | 2033309 | 3/1981 |
| FR | 934670 | 5/1948 |
| FR | 2376637 | 9/1978 |
| JP | 538265 | 1/1978 |
| JP | 538266 | 1/1978 |
| JP | 538270 | 1/1978 |
| NL | 8702093 | 4/1987 |

* cited by examiner

*Primary Examiner*—Victor Batson
*Assistant Examiner*—David C Reese
(74) *Attorney, Agent, or Firm*—Kenneth L Tolar

(57) ABSTRACT

A jewelry item having a rotatable gemstone includes a substantially hollow housing having a bezel and gemstone rotatably mounted on the upper end thereof. Received within the housing is a quartz movement type motor that operates a plurality of interrelated, contiguous gears to rotate the bezel. The gear ratios are such that the bezel will rotate at a predetermined, deliberate speed to achieve a desired aesthetic affect. A switch having a battery mounted thereon is hingedly attached to a side edge of the housing for activating the motor.

8 Claims, 6 Drawing Sheets

JEWELRY ITEM WITH ROTATING GEMSTONE

BACKGROUND OF THE INVENTION

The present invention relates to a jewelry item having an automatically rotatable, ornamental gemstone thereon.

DESCRIPTION OF THE PRIOR ART

Various jewelry items such as watches, brooches, pins, pendants, necklaces, rings and bracelets are worn for decorative or aesthetic purposes. Typically, such items include an ornamental gemstone. Gemstone motion generally results in variable light refraction and reflection thereby enhancing the aesthetic effect of the jewelry item.

A myriad of jewelry items, some of which contain movable gemstones, exist in the prior art. However, most of these devices include a gemstone that must be moved manually or with gravitational force. Furthermore, at least one conventional jewelry item employs a battery operated motor to rotate a gemstone. However, such devices are burdensome to operate and are limited in the duration and speed with which the gemstone is moved or rotated as will be explained in more detail, infra.

For example, U.S. Pat. No. 6,408,647 issued to Koll discloses a jewelry item having an automatically rotatable design element. Automatic rotation is provided by a micro-motor assembly received within a casing mounted to the jewelry item. The micro-motor assembly is powered by a battery.

U.S. Pat. No. 1,025,447 issued to Blume discloses a jewelry article having a design carrying member that is rotated with a spring motor.

U.S. Pat. No. 4,270,366 issued to Green discloses a rotatable mounting for a necklace gemstone including a journal having an axial shank rotatably extending therethrough. A gem stone is mounted on a first end of the shank. The opposing end has an outwardly extending lever that frictionally engages a wearer's underlying skin or clothing to effect angular displacement of the shank member relative to the journal.

Several foreign patents disclose rotating gemstones; for example, Swiss patent no. CH666996 issued to Paolini discloses a stone setting that is rotated with an electric motor.

As indicated above, many of the conventional jewelry items having movable gemstones employ manual drive means that are burdensome to operate and have limited versatility. Although '647 issued to Koll, supra, discloses a jewelry item having an automatically rotatable gemstone, the device employs a battery operated micro-motor that rotates the stone at a substantially rapid speed. The speed with which the stone rotates not only diminishes the aesthetic effect, but also quickly depletes the batteries requiring frequent replacement. Additionally, the micro-motor described therein is energy inefficient also contributing to short battery life.

The mechanical or manually operated devices listed above are burdensome to operate and are limited in rotation duration and speed. Furthermore, the rotational gemstone speed in the mechanical devices cannot be precisely controlled.

The present invention overcomes the disadvantages associated with the prior art by providing a jewelry item having a gemstone that is rotated with a specially designed quartz movement motor. The motor includes a plurality of gears having a predetermined gear ratio designed to achieve a discrete, somewhat deliberate rotational speed. The deliberate speed provides an enhanced aesthetic effect resulting from the reflection and sparkling of the slow moving gemstone.

Furthermore, the quartz movement motor gear ratio in combination with the multiple gear arrangement provides a smooth, continuous rotation that has not been heretofore associated with conventional quartz movement motors. Finally, the quartz movement motor is extremely efficient thereby resulting in prolonged battery life not otherwise available in conventional jewelry micro-motor assemblies.

SUMMARY OF THE INVENTION

The present invention relates to a jewelry item having a rotatable gemstone. The device comprises a housing having a quartz movement motor and gear assembly received therein. The gear assembly includes a drive gear, an intermediate gear and a bezel gear; the bezel gear is attached to a gemstone bezel. The respective gear ratios are specifically designed to achieve a predetermined rotational speed. The motor assembly includes a casing having an arcuate indention for removably receiving a battery mounted on a switch member. Accordingly, operation of the motor results in rotation of the bezel and gemstone mounted thereon.

It is therefore an object of the present invention to provide a jewelry item having a gemstone that is automatically rotatable with a motor.

It is another object of the present invention to provide a jewelry item that provides a discrete aesthetic appearance.

It is yet another object of the present invention to provide a jewelry item that allows a user to conveniently and automatically rotate a gemstone at a select speed and for a prolonged duration.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
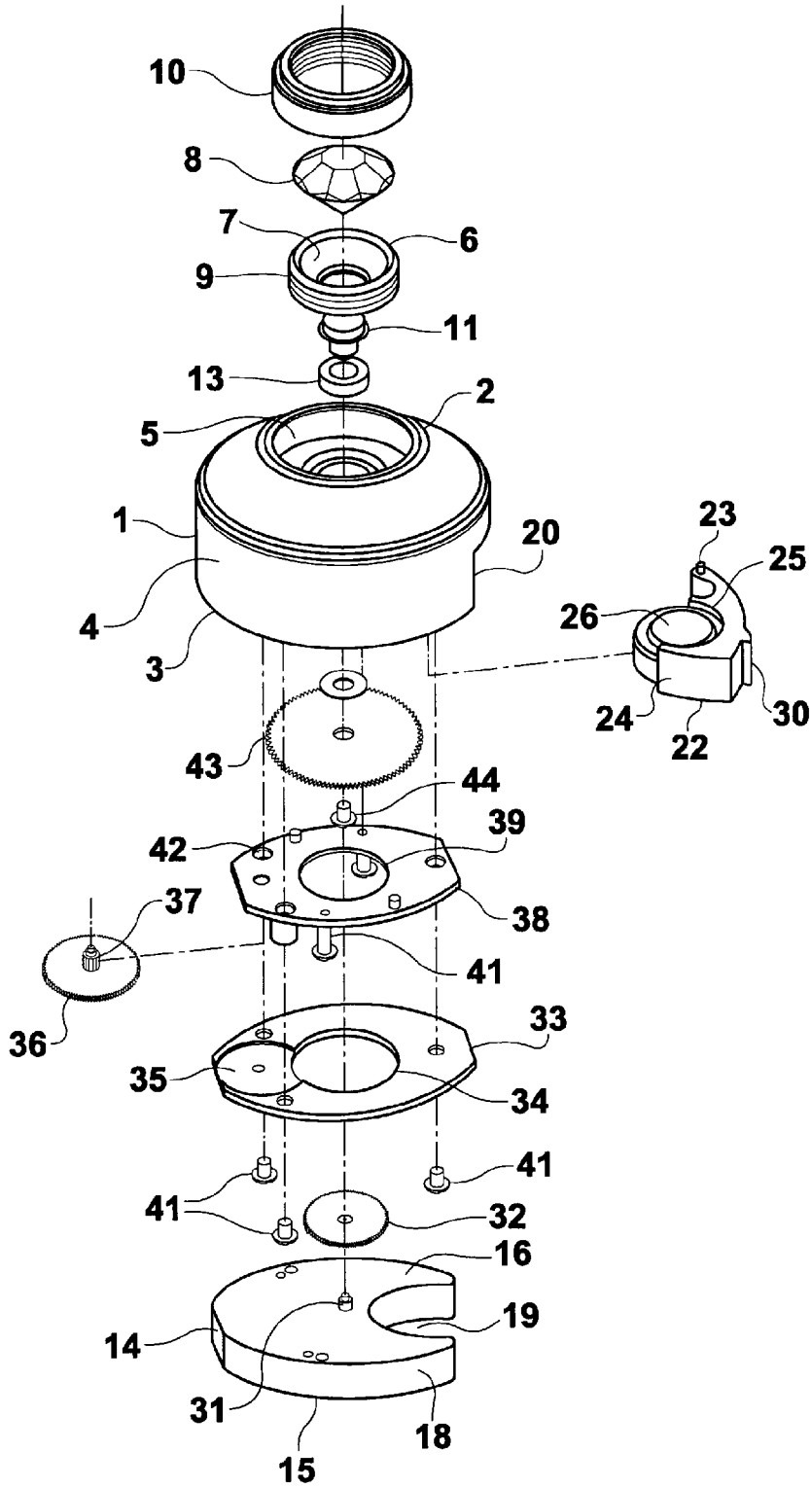
FIG. 1 is an exploded, perspective view of the jewelry item as viewed from top to bottom.
Figure 2:
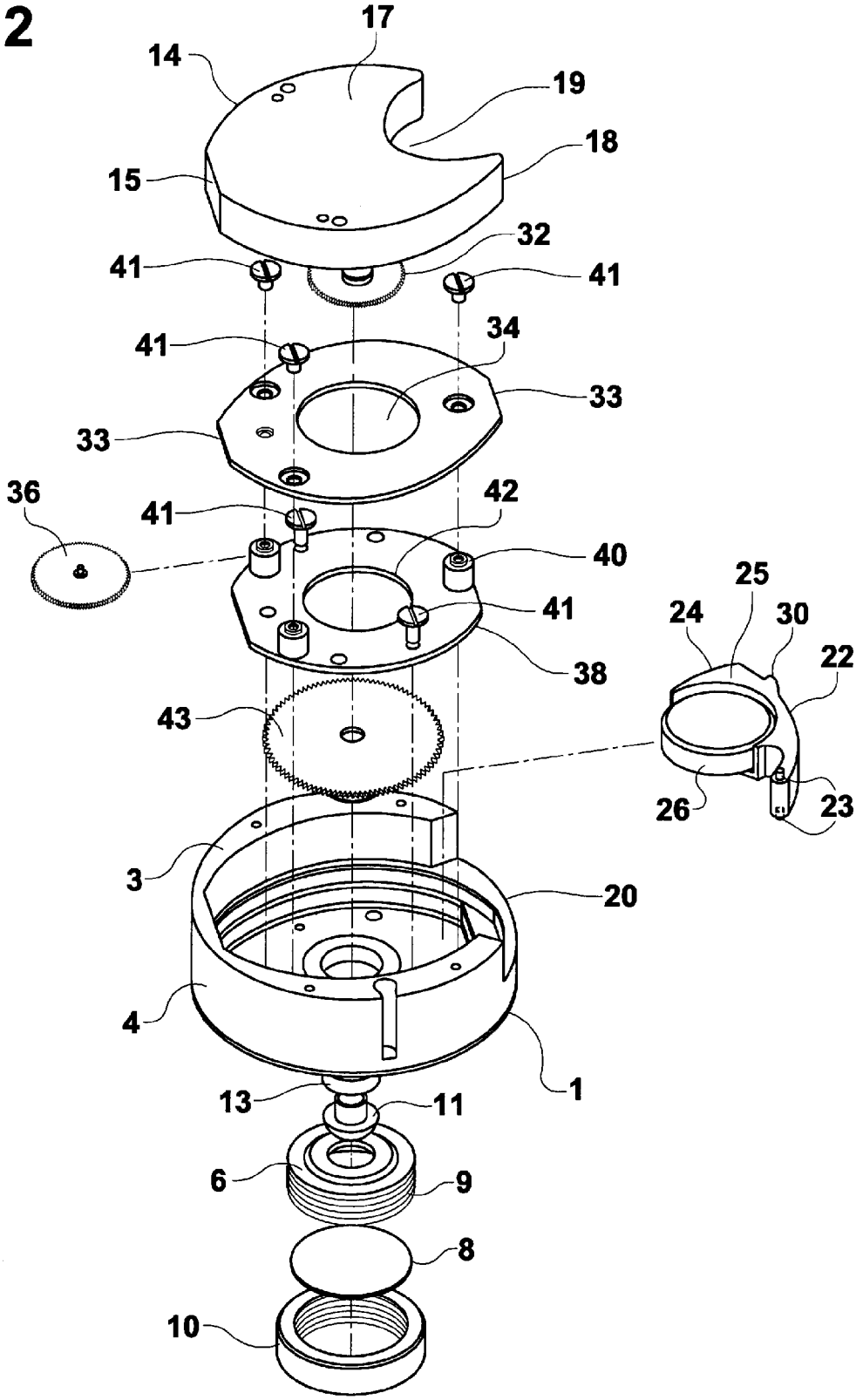
FIG. 2 is an exploded, perspective view of the jewelry item as viewed from bottom to top.
Figure 6:
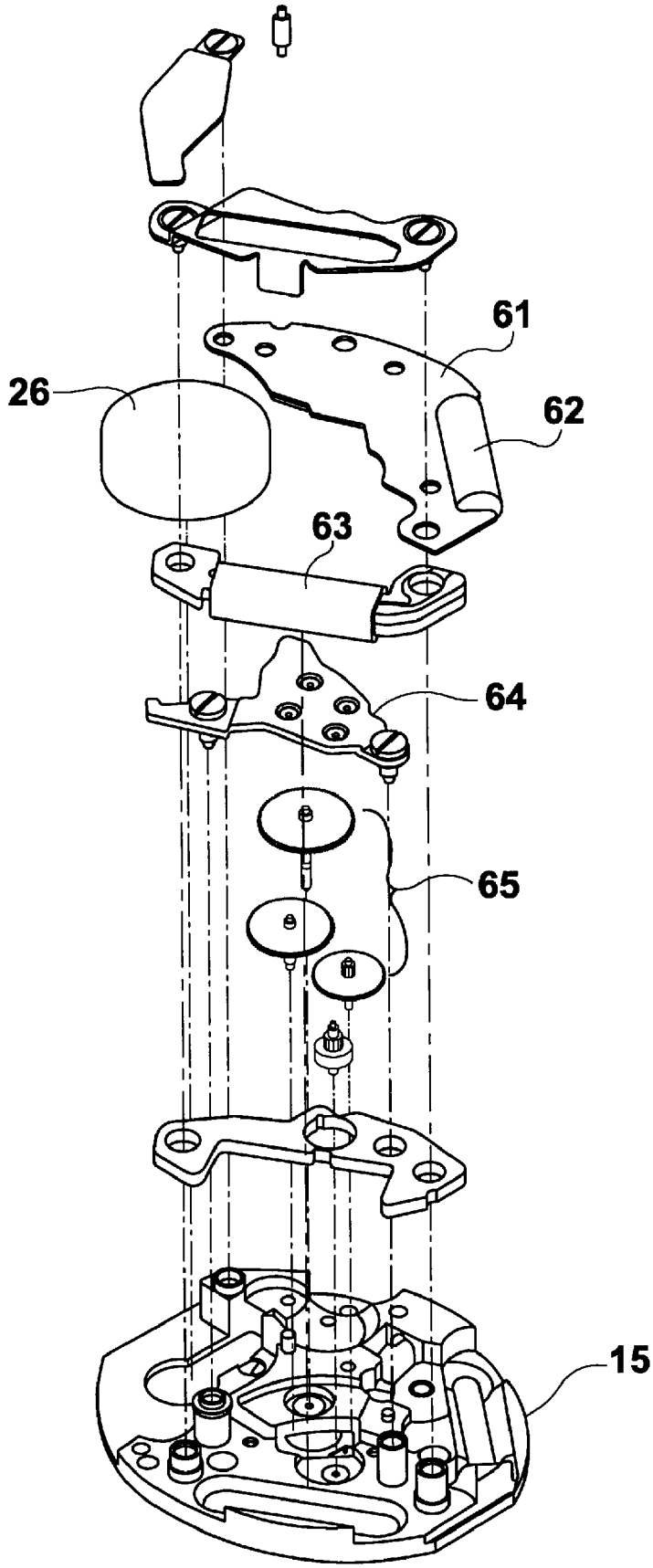
FIG. 6 is an exploded, detailed view of the quartz movement motor according to both embodiments of the present invention.

Now referring to FIGS. 1, 2 and 6, the present invention relates to a jewelry item having an automatically rotatable gemstone. The device comprises a substantially hollow, disk-shaped housing 1 having an upper end 2, a lower end 3 and a continuous outer wall 4. The upper end of the housing includes a semi-cylindrical cavity 5 thereon that receives a gemstone mounting assembly.

The gemstone mounting assembly includes a bezel 6 with a top gemstone mounting portion 7 that receives a gemstone 8 such as a diamond. The bezel includes an externally threaded outer periphery 9 to which an internally threaded collar 10 can be secured to retain the gemstone within the gemstone mounting portion. Attached to the lower end of the bezel is a connector 11 and a friction bearing 13 for attaching to a motor assembly described in more detail infra.

The motor assembly is received within the housing and includes a quartz movement electric motor 14 encompassed in a casing 15 having an upper surface 16, a lower surface 17 and a substantially continuous peripheral edge 18. The peripheral edge includes an arcuate indention 19 thereon. The indention includes electrical contacts electrically connected to the motor drive means received within the casing.

The housing includes an opening 20 on the continuous outer wall that is substantially aligned with the arcuate indention on the motor casing. A switch member 22 is hingedly attached at one end 23 to the housing with an opposing end 24 being free. The free end of the switch includes an arcuate battery receptacle 25 for removably receiving a watch type battery 26 to power the electric motor. The free end may be pivoted inwardly toward the housing opening until the battery engages the electrical contacts within the motor indention to activate the motor. The free end can be pivoted outwardly to a first position to disable the motor or to a second position to replace the battery if necessary. Accordingly, the switch includes a thumb ridge 30 which may be grasped by a user when pivoting the switch.

Now referring specifically to FIG. 6, the motor assembly includes the battery 26 and an integrated circuit 61 for controlling the speed and torque of the motor. The circuit is specifically designed to produce a predetermined deliberate speed and high torque so as to achieve a desired aesthetic effect as will be more readily apparent from the description below. The motor further includes conventional components such as a crystal 62, a coil 63, a bearing housing 64 and gears 65 for rotatably driving a series of interrelated gears as described below.

On the upper surface of the motor casing is a drive shaft 31 and drive gear 32 operably connected to the motor gears. A lower spacer plate 33 is superimposed on the motor casing and includes a centrally disposed aperture 34. The drive gear is positioned within the aperture and lies in substantially the same plane as the lower spacer plate. The lower spacer plate also includes a circular depression 35 on the upper surface thereof that receives an intermediate gear 36. The intermediate gear and depression are positioned so that the intermediate gear outer teeth engage the teeth on the drive gear. The intermediate gear includes a vertical sprocket 37 on its upper surface.

Superimposed on the lower spacer plate is an upper spacer plate 38 likewise having a centrally disposed aperture 39. The upper spacer plate includes threaded posts 40 on its lower surface. Screws 41 are inserted through apertures on the lower plate and are fastened to the threaded posts to couple the upper and lower plates. Screws are likewise fastened to threaded bores within the housing to secure the motor and gear assembly therein.

The upper plate also includes an aperture 42 adjacent an edge thereof positioned to receive the sprocket on the intermediate gear. Positioned immediately above the upper spacer plate is a bezel gear 43 that engages and is driven by the intermediate gear sprocket. The bezel gear is fastened to the lower end of the bezel connector with a screw 44 or similar fastener. The spacer plates provide support and structural integrity to the gears while assuring adequate separation therebetween allowing them to freely rotate in unison.

In addition, the respective gear ratios of the drive gear, the intermediate gear and the bezel gear are such that the rotational speed of the bezel gear, and thus the bezel and gemstone, are within a predetermined range. In the preferred embodiment, the target rotational speed of the bezel is approximately 2 to 4 revolutions per minute. Such a deliberate rotational speed enhances the aesthetic effect of the gemstone. However, as will be readily apparent to those skilled in the art, the gear ratios, and thus the desired rotational speed of the bezel as well as the motor torque, can be varied to suit a particular application. Furthermore, the multiple gear arrangement described above provides a smoother, more continuous rotation as opposed to the pulsing type movement associated with conventional quartz motors.

Figure 3:
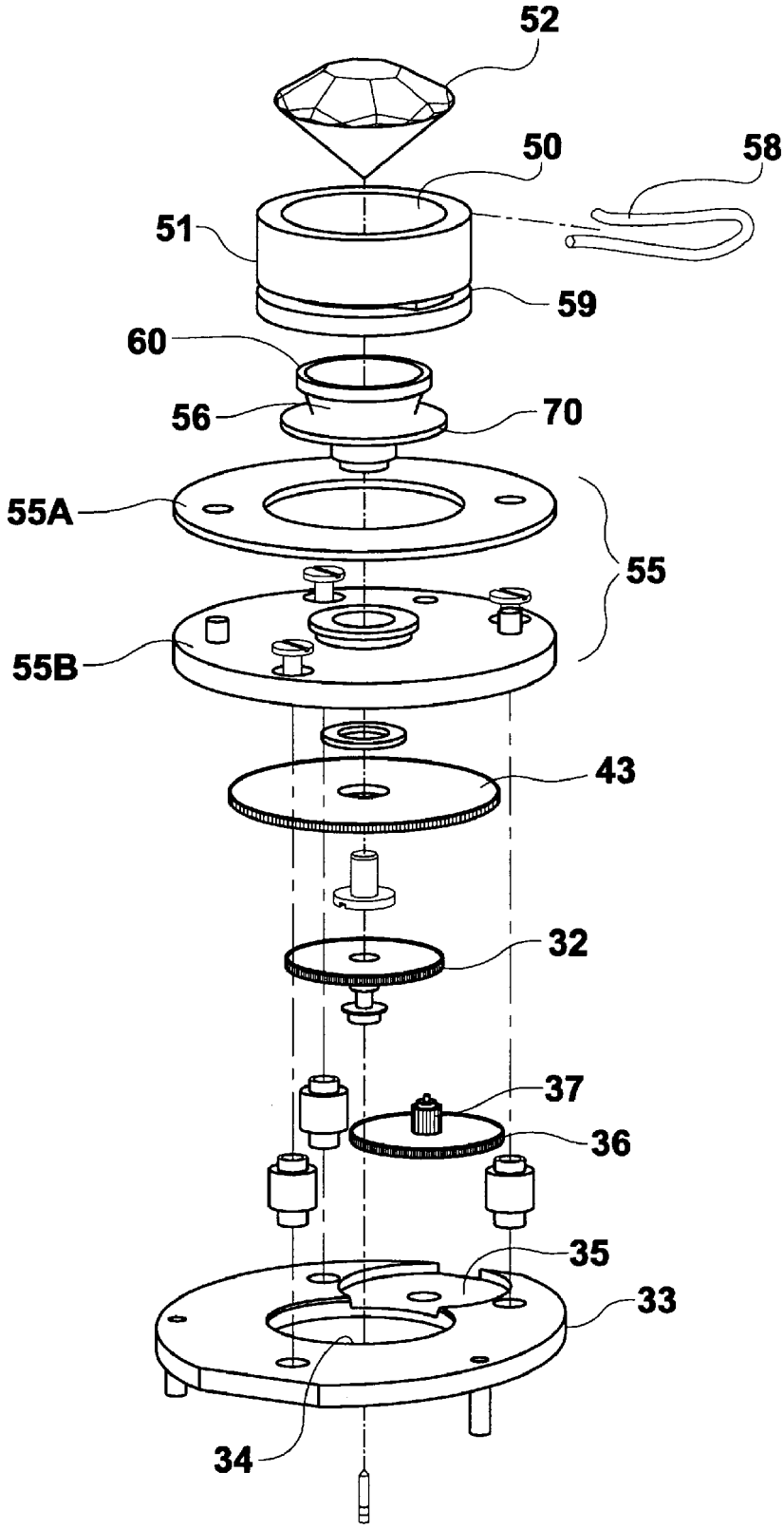
FIG. 3 is an exploded view of a second embodiment according to the present invention.
Figure 4:
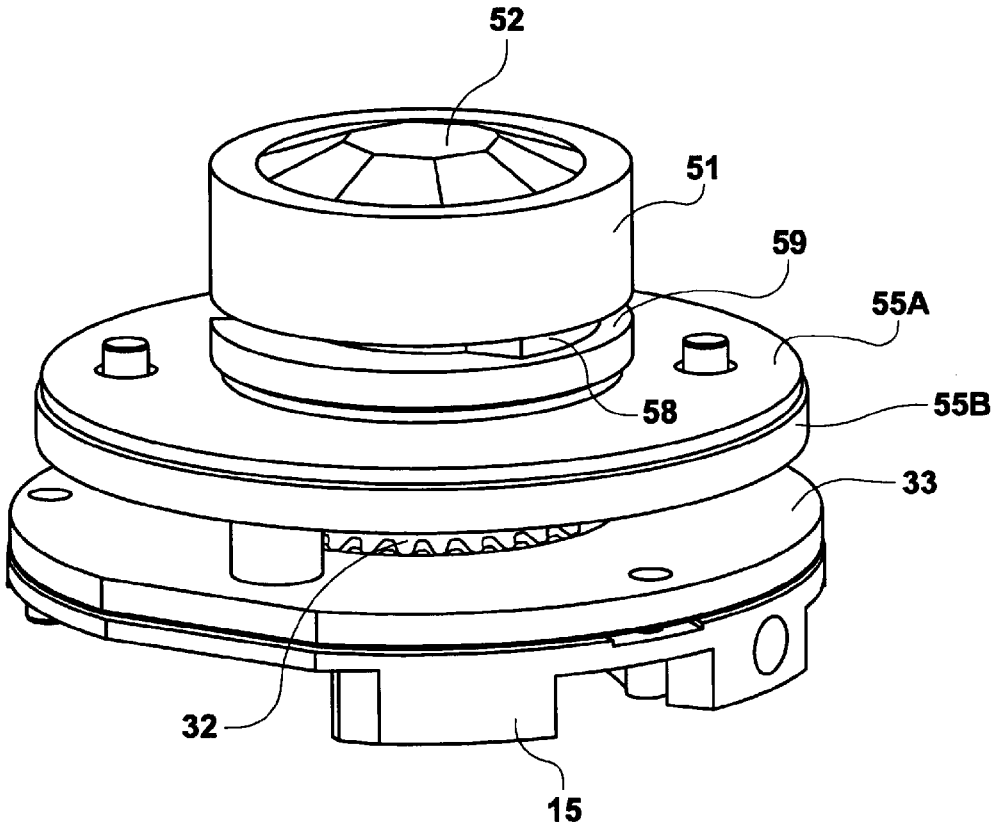
FIG. 4 is a perspective view of the embodiment depicted in FIG. 3.
Figure 5:
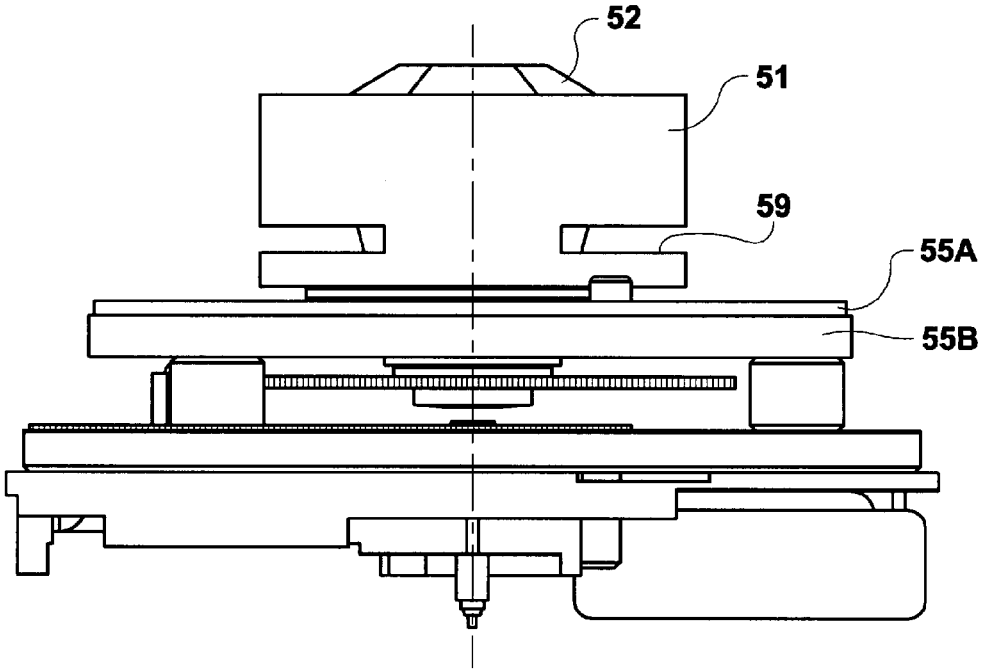
FIG. 5 is a cross-sectional view of the embodiment depicted in FIGS. 3 and 4.

Now referring specifically to FIGS. 3-5, a second embodiment is depicted that includes a slightly varied bezel and attachment means. The bezel 51 includes a gemstone mounting portion 50 at an upper end that receives a gemstone 52 and a peripheral slot 59 at a lower end. A slightly modified spacer plate 55 includes an upper section 55A and a lower section 55B. The upper section includes a centrally disposed aperture with a shroud 70 received therein. The shroud includes an upwardly projecting neck 56 having a lip 60 circumferentially disposed on an upper end. The neck is attached to the bezel gear 43 using conventional fasteners. The bezel is attached to the neck by placing it thereover with the neck lip positioned in a horizontal plane above that of the bezel slot. A substantially U-shaped clip 58 is inserted into the bezel slot thereby retaining the bezel on the neck. The switch, the interrelation of the gears and the other components are substantially similar to that described in detail above.

The above described device may be mounted to any desired jewelry item such as a necklace, bracelet, watch, pendant or brooch. A user can easily rotate the gemstone or design element to enhance the aesthetic effect thereof by depressing the free end of the switch inwardly until the battery properly engages the contacts thereby activating the quartz motor.

The above described device is not limited to the exact details of construction and arrangement of parts shown described. Furthermore, the size, shape and materials and construction of the various components may be varied to suit a particular application.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A jewelry item with a rotating gemstone comprising:

a substantially hollow housing having an upper end and a lower end;

a bezel rotatably mounted on the upper end of said housing;

a gemstone mounted on said bezel;

a motor means received within said housing for automatically rotating said bezel and said gemstone at a predetermined, discrete speed;

a gear assembly including a plurality of gears driven by said motor means and operably connected to said bezel, said gears having a predetermined, precise gear ratio for rotating said bezel at a discrete speed, wherein said gear assembly further includes a drive gear connected to said motor means, an intermediate gear engaging said drive gear, said intermediate gear having an upper surface with a sprocket extending therefrom and a bezel gear connected to said bezel and engaging said sprocket;

a lower spacer plate superimposed on said drive gear, said spacer plate having an aperture with said drive gear received therein, wherein said lower spacer plate includes a depression thereon that receives said intermediate gear.

2. The jewelry item according to claim 1 wherein said discrete speed is between 2 and 4 revolutions per minute.

3. The jewelry item according to claim 1 wherein said motor means includes a quartz movement motor.

4. The jewelry item according to claim 3 wherein said motor means further comprises an integrated circuit for controlling speed and torque of said quartz movement motor.

5. The jewelry item according to claim 3 wherein said quartz movement motor includes a casing having an outer edge with an indention thereon, said indention substantially aligned with an opening on an outer wall of said housing, said indention having at least one electrical contact therein, said electrical contact electrically connected to said motor.

6. The jewelry item according to claim 5 further comprising a switch hingedly secured at a first end to said housing, said switch carrying a battery thereon, said switch having a free end which is pivotal towards and away from said housing to selectively position said battery against said contact.

7. The jewelry item according to claim 1 further comprising:

a neck projecting upwardly from said bezel gear, said neck having a peripheral lip;

said bezel receiving said neck, said bezel including a circumferential slot positioned beneath said lip;

a clip received within said slot to retain said bezel on said neck.

8. The jewelry item according claim 1 further comprising an upper spacer plate superimposed on said lower spacer plate with said intermediate gear positioned therebetween.

* * * * *